US008282204B2

(12) United States Patent
Kanada et al.

(10) Patent No.: US 8,282,204 B2
(45) Date of Patent: Oct. 9, 2012

(54) PRINTING APPARATUS

(75) Inventors: Hidemasa Kanada, Matsumoto (JP); Kazunori Shirasawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 411 days.

(21) Appl. No.: 12/621,725

(22) Filed: Nov. 19, 2009

(65) Prior Publication Data

US 2010/0157006 A1 Jun. 24, 2010

(30) Foreign Application Priority Data

Dec. 24, 2008 (JP) ..... 2008-327904

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS 5,668,584 A * 9/1997 Broder et al. ..... 347/102

FOREIGN PATENT DOCUMENTS

JP 2003-182168 7/2003

* cited by examiner

*Primary Examiner* — Omar Rojas
(74) *Attorney, Agent, or Firm* — Workman Nydegger

(57) ABSTRACT

A printing apparatus includes: a medium holding unit which is divided into a plurality of members to form a holding surface and holds a printing medium being transported on the holding surface; a heat transfer type first heating unit which is disposed in the medium holding unit and heats the printing medium held by the medium holding unit; and a printing head which performs printing by ejecting ink onto the printing medium. Boundaries formed by gaps between the plurality of members on the holding surface of the medium holding unit are curved in both a transport direction and a width direction of the printing medium so as not to be in a straight line shape in the transport direction.

5 Claims, 11 Drawing Sheets

PRINTING APPARATUS

BACKGROUND

1. Technical Field

The present invention relates to a printing apparatus including a medium holding unit which is divided into a plurality of members to form a holding surface and which holds a printing medium being transported on the holding surface, a heat transfer type heating unit which is disposed in the medium holding unit and heats the printing medium held by the medium holding unit, and a printing head which performs printing by ejecting ink onto the printing medium.

In the specification, examples of the printing apparatus include an ink jet printer, a wire dot printer, a laser printer, a line printer, a copy apparatus, and a facsimile.

2. Related Art

In the past, a printing apparatus disclosed in Japanese Patent No. 3839316 included a printing head, a platen serving as a medium holding unit, and a heater serving as a heat transfer type heating unit.

Here, "the heat transfer type" refers to a method of transferring heat from a high temperature portion to a low temperature portion by passing it through the inside of an object. That is, the heat transfer type refers to a method of transferring heat by bringing the platen, which is the object into contact with a sheet, which is an example of the printing medium. The heat transfer type is also called "a contact type".

The printing head is provided so as to perform printing by ejecting ink onto the sheet. The platen is provided so as to face the printing head and holds the sheet from the rear surface.

The heater is provided opposite the side of the platen holding the sheet and heats the sheet on the platen through the platen. The reason for heating the sheet on the platen is to promote the drying of the ink ejected onto the sheet. The platen is constituted by a plurality of members, since the platen expands due to the heat of the heater. In addition, narrow gaps are formed in the boundaries of the adjacent members. Therefore, since the gaps can absorb the expansion caused by the heat, it is possible to prevent the platen from being bent. As a consequence, the distance between the platen and the printing head can be maintained so as to be uniform.

FIGS. 11A and 11B are diagram illustrating a platen as an example of a known technique. FIG. 11A is the plan view illustrating the platen. FIG. 11B is the diagram illustrating the temperature of the positions of a sheet corresponding to the positions of the platen in a width direction of the platen shown in FIG. 11A.

The vertical axis represents the temperature. The horizontal axis represents the position of the sheet corresponding to the positions of the platen in the width direction of the platen.

As shown in FIG. 11A, a platen 200 according to a known technique includes a first member 201, a second member 202, and a third member 203. Gaps 205 are formed in the boundaries 204 of the adjacent members and screw holes 206 are screw-fixed to a plate-shaped member (not shown) provided on a lower side. A heater (not shown) for heating a sheet on the platen 200 is mounted so as to be interposed between the platen 200 and the plate-shaped member (not shown). The boundaries 204 are formed in a straight line so as to be inclined in a transport direction Y.

When the sheet passes through the platen 200 in the transport direction Y, as shown in FIGS. 11A and 11B, the sheet is heated by the heater and thus the temperature of the sheet increases.

A dot-dash line in FIG. 11B indicates the temperature of the sheet before the sheet passes through the platen 200. A solid line indicates the temperature of the sheet after the sheet passes through the platen 200.

Before the sheet passes through the platen 200, the temperature of the sheet is uniform in a width direction X.

When the sheet passes through the platen 200 in a transport direction Y, the heat of the heater can be transferred through the platen 200. Accordingly, the temperature of the sheet can be increased.

However, the temperature of the sheet passing through areas N where the boundaries 204 are formed in the width direction X is considerably lower than the temperature of the sheet passing through areas M where the boundaries 204 are not formed. Moreover, the irregularity in the temperature is large in the areas where the temperature of the sheet is low and the areas where the temperature of the sheet is high.

The areas M and N in the width direction X will be described.

The areas M are areas where there is no boundary 204 in the transport direction Y. On the other hand, the areas N are areas where there are the boundaries 204 in the transport direction Y.

Since the sheet passing through the areas M in the width direction X is not influenced by the gaps 205 of the boundaries 204, it is easy to be heated. Accordingly, the temperature of the sheet passing through the areas M is relatively high.

The sheet passing through the areas N passes through the boundaries 204 formed in the transport direction Y by a gap L of a component of the transport direction Y in each boundary 204 inclined in the transport direction Y. It is difficult for the sheet to be heated, since the sheet is not in contact with the platen 200 while the sheet passes through the boundaries. Accordingly, the temperature of the sheet passing through the areas N is lower than that of the sheet passing through the areas M. The larger the ratio of the gap L, which is the component of the transport direction Y to the length of the platen 200 in the transport direction Y, the larger the difference in the temperature.

The larger the inclination of the boundary 204 with respect to the transport direction Y, the lower the temperature over a board range. That is, the temperature becomes irregular over a broad range.

For this reason, an irregularity in the temperature and an irregularity in the dryness in the width direction X may be caused. Moreover, the irregularity in the temperature may cause discoloration of the ink.

The same applies to a case where the boundary is not inclined in the transport direction Y but is formed in a straight line parallel to the transport direction Y. In this case, the difference in the temperature is also significant.

When an end of the sheet is transported to and positioned on the boundaries in the case where the boundaries 204 are inclined in the transport direction Y, an end of the sheet may be stuck in the boundaries 204. Therefore, a problem arises in that the entire sheet passes obliquely or so-called sheet folding that the end of the sheet is curved occurs.

SUMMARY

An advantage of some aspects of the invention is that it provides a printing apparatus capable of reducing irregularity in the temperature of a printing medium in a width direction with respect to a transport direction, when the printing medium being transported is heated.

According to an aspect of the invention, there is provided a printing apparatus including: a medium holding unit which is divided into a plurality of members to form a holding surface and holds a printing medium being transported on the holding surface; a heat transfer type first heating unit which is disposed in the medium holding unit and heats the printing medium held by the medium holding unit; and a printing head which performs printing by ejecting ink onto the printing medium. Boundaries formed by gaps between the plurality of members on the holding surface of the medium holding unit are curved in both a transport direction and a width direction of the printing medium so as not to be in a straight line shape in the transport direction.

Here, "the heat transfer type" refers to a method of transferring heat from a high temperature portion to a low temperature portion by passing it through the inside of an object. That is, the heat transfer type refers to a method of transferring heat by bringing the object into contact with the printing medium and is also called "a contact type".

According to the above aspect of the invention, the boundaries formed by the gaps between the plurality of members on the holding surface of the medium holding unit are curved in the transport direction and the width direction of the printing medium so as not to be formed in the straight line shape in the transport direction. With such a configuration, on the holding surface of the medium holding unit, the components of the transport direction in the boundaries between the plurality of members can be regulated so as not to be focused on a specific region in the width direction. That is, the components of the transport direction in the boundaries between the plurality of members can be dispersed in the width direction.

As a consequence, in the case where the printing medium passes while the medium holding unit is heated, the irregularity in the temperature of the printing medium in the width direction can be decreased. That is, since it is difficult to transfer heat in the width direction, a range in which the temperature of the printing medium is considerably lower than the temperature of the other regions can be prevented from occurring. It is possible to reduce an irregularity in the temperature and irregularity in the dryness in the width direction. Moreover, it is possible to reduce irregularity in discoloration of the ink caused due to the irregularity in the temperature.

The boundaries are not obliquely inclined with respect to the transport direction. Accordingly, there will hardly be any occurrences of an end of the printing medium being located on the boundaries, and the end of the printing medium being stuck in the boundaries. Therefore, the entire sheet does not pass obliquely or so-called sheet folding that the end of the sheet is curved does not occur.

The printing apparatus according to the aspect of the invention may further include a convection type second heating unit which blows warm air onto the printing medium held on the holding surface through the gaps of the boundaries between the plurality of members of the medium holding unit.

Here, "the convection type" refers to a method of transferring heat by a fluid such as a gas or a liquid.

The printing apparatus having this configuration further includes the convection type second heating unit which blows warm air onto the printing medium held on the holding surface through the gaps of the boundaries between the plurality of members of the medium holding unit. With such a configuration, it is possible to actively transfer heat toward the regions of the printing medium facing the gaps in the convection manner. As a consequence, the difference between the temperature of the regions of the printing medium facing the gaps and the temperature of the regions which do not face the gaps can be reduced or eliminated. That is, it is possible to reduce or eliminate the irregularity in the temperature of the printing medium.

The printing apparatus according to the above aspect of the invention may further include a plurality of suction holes which are formed in the holding surface of the medium holding unit; and a suction unit which sucks air from the side of the holding surface of the medium holding unit toward an opposite side of the holding surface through the suction holes. The convection type second heating unit may blow warm air to the printing medium through the gaps of the boundaries by using air discharged when the air heated by the heat transfer type first heating unit is sucked by the suction unit.

In the printing apparatus having this configuration, the convection type second heating unit blows the warm air onto the printing medium through the gaps of the boundaries by using air discharged when air heated by the heat transfer type first heating unit is sucked by the suction unit. With such a configuration, warm air is not wasted. Therefore, it is not necessary to provide a separate mechanism except for the suction unit. That is, an appropriate configuration may be realized.

In the printing apparatus according to the above aspect of the invention, the first heating unit may be screw-fixed to the printing holding unit from an opposite side of the holding surface of the medium holding unit.

In the printing apparatus having this configuration, the first heating unit is screw-fixed to the printing holding unit from an opposite side of the holding surface of the medium holding unit. With such a configuration, unnecessary unevenness or spaces are not formed on the holding surface of the medium holding unit.

When the first heating unit is screw-fixed from the holding surface side, the screw-fixed regions are concave and thus there is hardly any transfer of heat. In order to make the holding surface flat, the screw-fixed regions may be covered with caps. In this case, however, since unnecessary spaces are formed below the caps, there is hardly any transfer of heat.

In order to solve this problem, as described above, the first heating unit is screw-fixed to the printing holding unit from the opposite side of the holding surface of the medium holding unit.

As a consequence, there are no regions formed where there would be hardly any transfer of heat. That is, it is possible to uniformly transfer heat to the printing medium.

In the printing apparatus according to the above aspect of the invention, regions except for the gaps of the boundaries on the holding surface of the medium holding unit may be flush with each other so as to form a smooth surface.

In the printing apparatus having this configuration, the regions except for the gaps of the boundaries on the holding surface of the medium holding unit are flush with each other so as to form the smooth surface. With such a configuration, the holding surface can uniformly come in contact with the printing medium in the regions except for the gaps of the boundaries. As a consequence, it is possible to uniformly heat the printing medium in the regions except for the gaps of the boundaries.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the drawings.

Figure 1:
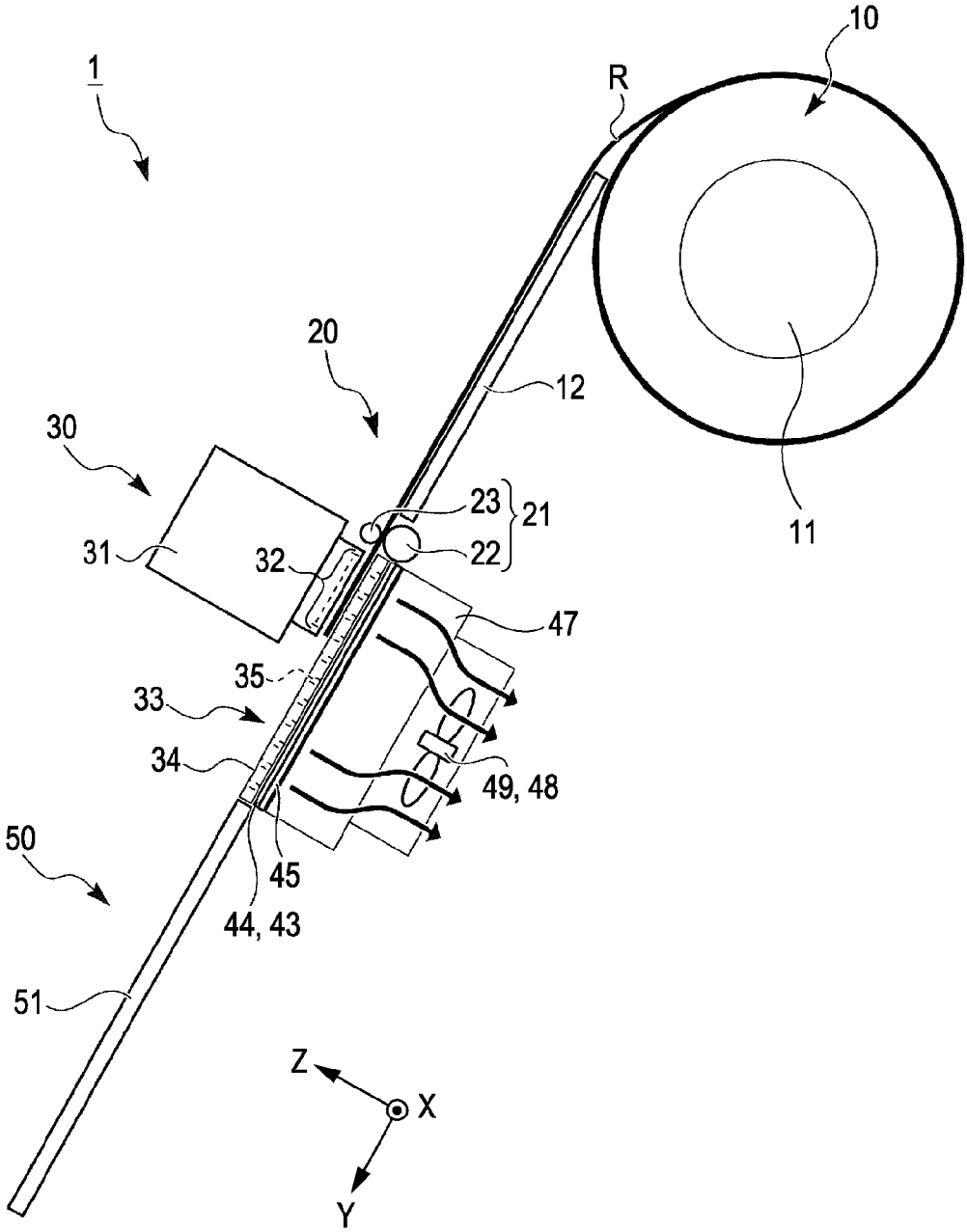
FIG. 1 is a side view illustrating the overall configuration of a printing apparatus according to the invention.

FIG. 1 is a side view illustrating the overall configuration of an ink jet printer 1 (hereinafter, referred to as "a printer") as an example of "a printing apparatus" or "a liquid ejecting apparatus" according to the invention.

Here, the liquid ejecting apparatus is not limited to a printing apparatus such as an ink jet printing apparatus, a copy apparatus, and a facsimile for performing printing on a printing medium by ejecting ink onto the printing medium such as a printing sheet from a printing head 31, which is a liquid ejecting head. The liquid ejecting apparatus refers to an apparatus for attaching a liquid onto the ejecting medium by ejecting the liquid corresponding to the specific use instead of ink from a liquid ejecting head corresponding to the above-described printing head 31 onto an ejecting medium corresponding to the printing medium.

Examples of the liquid ejecting head include the above-described printing head 31, a color material ejecting head used to manufacture a color filter such as a liquid crystal display, an electrode material (conductive paste) ejecting head used to form an electrode such as an organic EL display or a field emission display (FED), a bio organism ejecting head used to manufacture a bio chip, and a sample ejecting head ejecting a sample by the use of a precise pipette.

As shown in FIG. 1, the printer 1 includes a feeding unit 10, a transport unit 20, a printing unit 30, and a discharging unit 50. The feeding unit 10 is provided so as to feed an unrolled roll sheet R having a roll shape as an example of a printing medium to a downstream side (an arrow direction of a Y axis) in a transport direction. Specifically, the feeding unit 10 includes a roll medium holder 11 for holding the roll-shaped roll sheet R and a feeding table 12 holding the unrolled roll sheet R.

The roll sheet R is fed to the feeding table 12 by rotating the roll sheet R in a counterclockwise direction of the drawing. Subsequently, the feeding table 12 is configured so as to unroll the roll sheet R on the downstream side of the roll sheet R in the transport direction and guide the unrolled roll sheet R to the transport unit 20 on the downstream side in the transport direction.

In this embodiment, the roll sheet R is described as an example, but of course, a single sheet may be used.

The transport unit 20 is provided so as to transport the roll sheet R fed by the feeding unit 10 to the printing unit 30 on the downstream side in the transport direction. Specifically, the transport unit 20 includes a pair of transport rollers 21 constituted by a transport driving roller 22 and a transport driven roller 23. The transport driving roller 22 is driven by a transport motor (not shown).

The transport driven roller 23 is driven by the rotation of the transport driving roller 22. Accordingly, the transport unit 20 is capable of transporting the roller sheet R to the printing unit 30.

The shaft of the transport driven roller 23 is disposed on the downstream side of the shaft of the transport driving roller 22 in the transport direction. Accordingly, a force pushing the roller sheet R against a platen 33, which is described below, is generated in a Z axis direction in which the platen 33 faces the printing head 31, so that the roll sheet R is prevented from being lifted upward the printing head 31.

The printing unit 30 performs printing by ejecting ink onto the roll sheet R transported from the transport unit 20. Specifically, the printing unit 30 includes the printing head 31, the platen 33, a first heating unit 43, and a suction unit 48. The printing head 31 ejects the ink from nozzle rows 32, while being guided by a guide shaft (not shown) and moved in a width direction X by a motor (not shown).

The printing head 31 may be configured so as to be moved in the transport direction Y by the guide shaft.

Of course, the printing head 31 may be configured so as to be moved in the width direction X and the transport direction Y by two guide shafts.

Alternatively, a line head printer may be used in which the printing head 31 is disposed so as to extend in the width direction X and be fixed.

The platen 33 is provided so as to hold the roll sheet R from the rear surface of the roll sheet R by a medium holding surface 34. The first heating unit 43 and the suction unit 48 are formed in the platen 33. The first heating unit 43 is of a heat transfer type and provided so as to heat the roll sheet R on the platen 33.

Here, "the heat transfer type" refers to a method of transferring heat from a high temperature region to a low temperature region via the inside of the platen 33 as an object. That is, the heat transfer type is the method of transferring heat by bringing the platen 33 into contact with the roll sheet R.

The reason for heating the roll sheet R is to promote the drying of the ink ejected onto the roll sheet R from the printing head 31.

By promoting the drying of the ink, a so-called overlap printing process of ejecting ink droplets onto dried ink in an overlapping manner can be performed. As a consequence, an image of a high quality can be printed.

By heating the roll sheet R, ink on the surface of the roll sheet R is not smeared on the rear surface of the roll sheet R transported before or afterwards when the discharged roll sheet R is wound again in the roll shape in the discharge unit 50, which is described below.

In the case of single sheets, the rear surface of the single sheets stacked later is not smeared with ink from the surface of the single sheet stacked earlier.

Specifically, the first heating unit 43 is a heater 44 such as a nichrome wire. The nichrome wire generates heat by conducting the nichrome wire. The heater 44 is mounted using a plate-shaped member 45 on a side opposite to the medium holding surface 34 of the platen 33. In other words, the heater 44 is mounted so as to be interposed between the platen 33 and the plate-shaped member 45. In addition, the heater 44 is configured so as to transfer heat to the rear surface of the roll sheet R through the medium holding surface 34 of the platen 33.

The suction unit 48 sucks air from the side of the medium holding surface 34 of the platen 33 toward the side opposite to the medium holding surface 34. Therefore, the roll sheet R on the platen 33 can be sucked onto the medium holding surface 34. Specifically, the suction unit 48 includes a plurality of suction holes 35, a passage forming member 47, and a suction fan 49. The plurality of suction holes 35 are formed in the platen 33. The passage forming member 47 is disposed on a side of the plate-shaped member 45 opposite to the platen 33.

The suction fan 49 is disposed on a side of the passage forming member 47 opposite to the plate-shaped member 45. The passage forming member 47 is provided so as to form air passages from the plurality of suction holes 35 to the suction fan 49. The air on the medium holding surface 34 of the platen 33 is sucked from the plurality of suction holes 35, when the suction fan 49 creates negative pressure inside of the passage forming member 47. The sucked air is sucked through the passage forming member 47 by the suction fan 49 and discharged to the opposite side.

The discharge unit 50 is provided so as to send and discharge the roll sheet R printed by the printing unit 30 to the downstream side in the transport direction. Specifically, the discharge unit 50 includes a discharge table 51 and a winding roller (not shown). The discharge table 51 is provided so as to guide the printed roll sheet R to the winding roller. The winding roller is provided so as to wind up the guided roll sheet R.

In the case of single sheets, a discharge stacker (not shown) may be provided instead of the winding roller so that the single sheets are stacked in the discharge stacker.

Next, the platen 33 according to the invention will be described in detail.

Figure 2A:
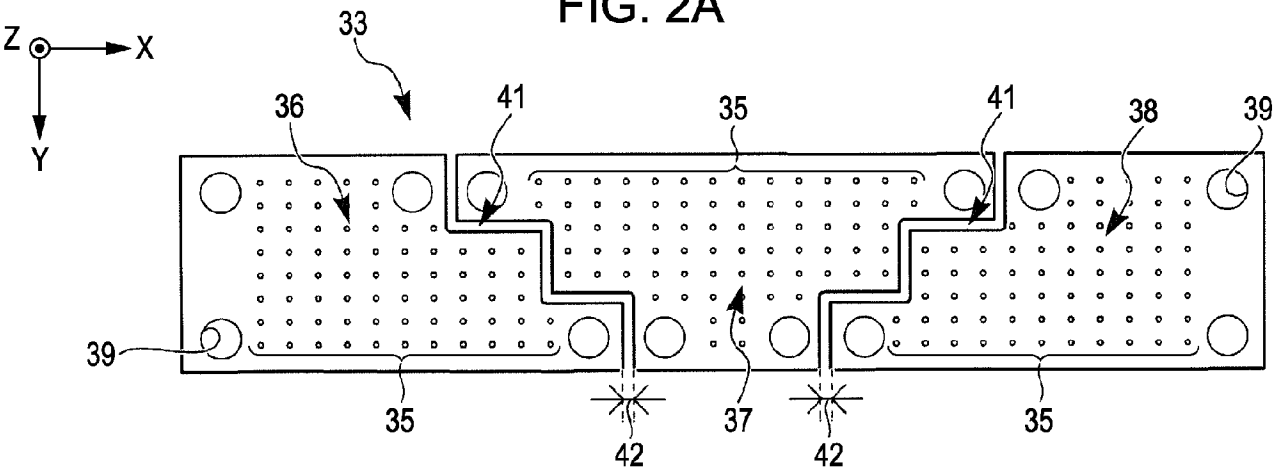
FIGS. 2A and 2B are a plan view and a front sectional view illustrating the overall configuration of a platen according to the invention.
Figure 2B:
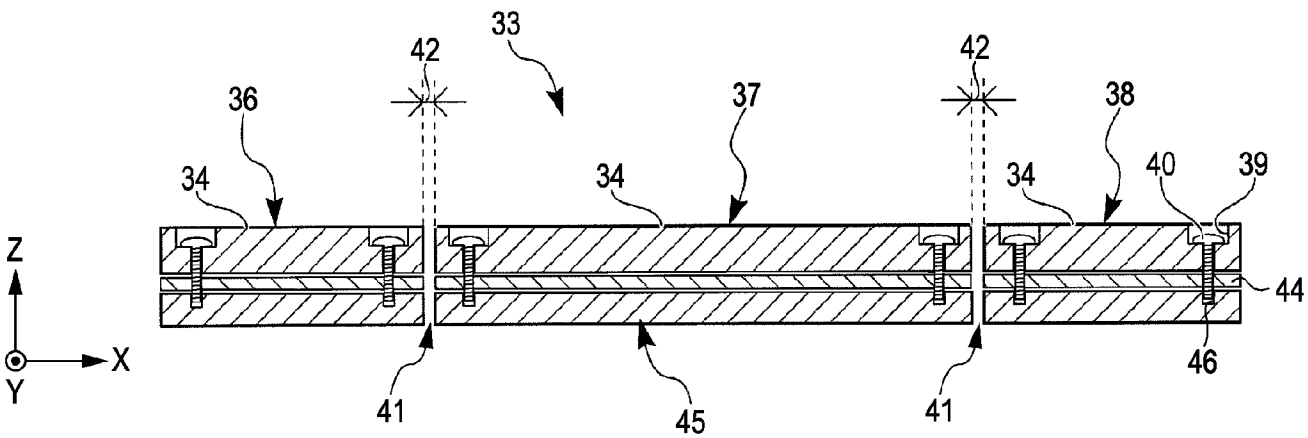

FIGS. 2A and 2B are a plan view and a front sectional view illustrating the overall configuration of the platen according to the invention. FIG. 2A is the plan view and FIG. 2B is the front sectional view.

As shown in FIGS. 2A and 2B, the medium holding surface 34 of the platen 33 is formed from a plurality of members. In this embodiment, three members, that is, a first member 36, a second member 37, and a third member 38 are formed, for example.

The boundaries 41 are formed by the adjacent members. In the boundaries 41, gaps 42 are formed between the adjacent members.

The reason for forming the medium holding surface 34 of the platen 33 from the plurality of members and form the gaps 42 in the boundaries 41 is to absorb the expansion of the members caused by the heating of the first heating unit 43. Accordingly, even when the first member 36, the second member 37, and the third member 38 are expanded due to being heated, the entire platen 33 is not considerably bent in the Z axis direction. As a consequence, printing precision does not deteriorate due to the heating.

In this embodiment, two boundaries 41 are curved in a zigzag shape in the width direction X and the transport direction Y so as to be bisymmetric. Accordingly, it is possible to absorb the expansion of the first member 36, the second member 37, and the third member 38 in the width direction X and the transport direction Y. As a consequence, since bending in the Z axis direction is rarely caused, the distance between the medium holding surface 34 and the printing head 31 can be maintained so as to be uniform.

As described above, the heater 44 is disposed so as to be interposed among the first member 36, the second member 37, and the third member 38 constituting the platen 33, and the plate-shaped member 45. More specifically, a plurality of screw holes 39 are formed in the medium holding surface 34 of the first member 36, the second member 37, the third member 38. In addition, a plurality of screws 40 are inserted into the screw holes 39 from the upper side of FIG. 2A to engage with female screw-shape portions 46 of the plate-shaped member 45. Accordingly, the heater 44 can be mounted so as to come in close contact with the platen 33 in parallel to the medium holding surface 34. As a consequence, heat can be uniformly transferred to the medium holding surface 34 of the platen 33.

Next, there will be a description of an advantage of obtained from the configuration in which the boundaries 41 are curved in the width direction X and the transport direction Y so as not to be formed in a straight line in the transport direction Y.

Figures 3A, 3B:
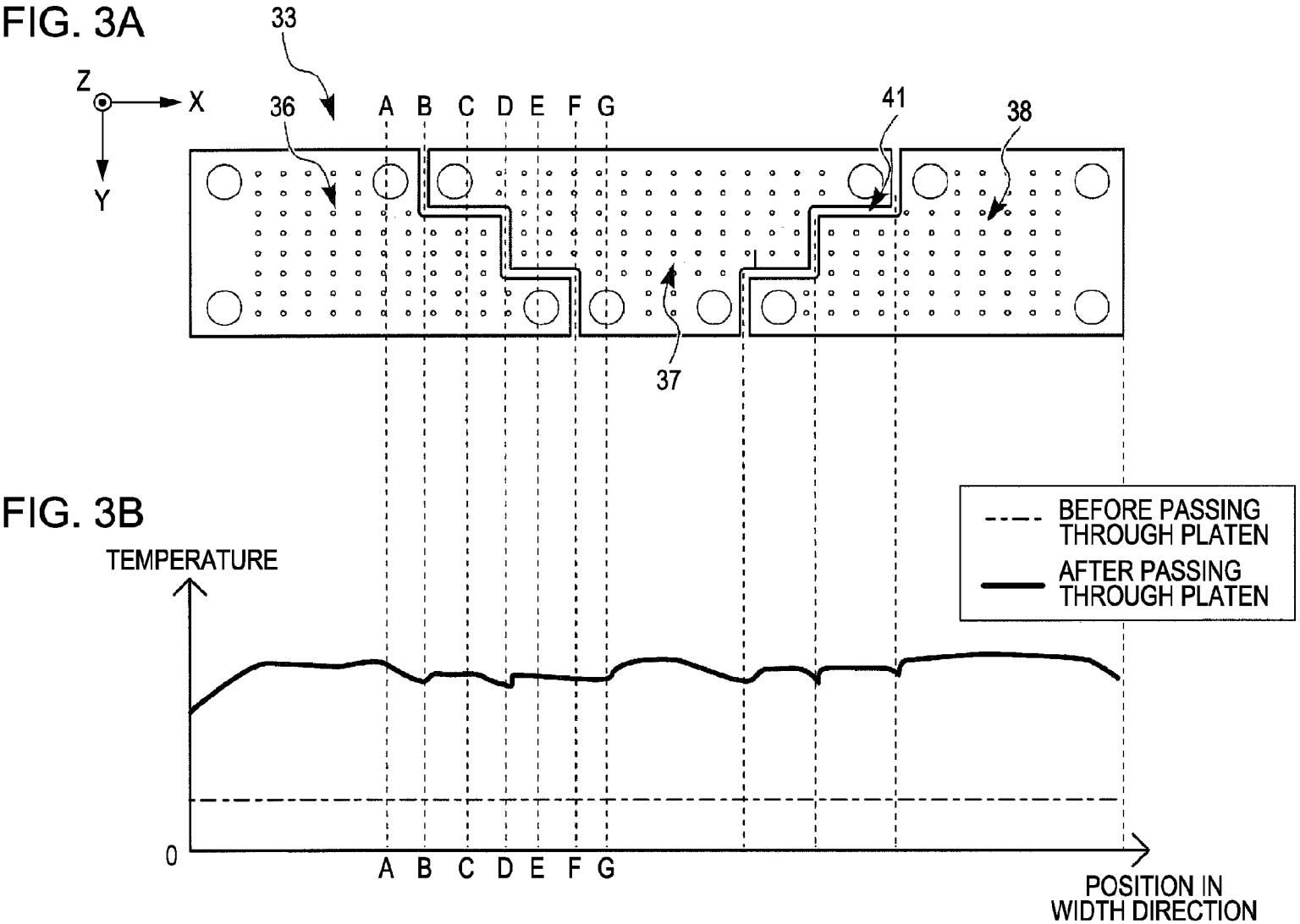
FIGS. 3A and 3B are a plan view illustrating the platen according to the invention and a diagram illustrating the temperature of a roll sheet in regions corresponding to the position of the platen.

FIG. 3A is a plan view illustrating the overall configuration of the platen as in FIG. 2A. FIG. 3B is a diagram illustrating the temperature of the roll sheet in regions corresponding to the position of the platen shown in FIG. 3A in the width direction. The vertical axis represents temperature and a horizontal axis represents the position of the roll sheet in the regions corresponding to the position of the platen in the width direction.

When the roll sheet R passes through the platen 33 in the transport direction Y, as shown in FIGS. 3A and 3B, the roll sheet R is heated by the heater 44, thereby increasing the temperature of the roll sheet R.

In FIG. 3B, a dot-dash line indicates the temperature of the roll sheet R before the roll sheet R passes through the platen 33. A solid line indicates the temperature of the roll sheet R after the roll sheet R passes through the platen 33.

Before the roll sheet R passes through the platen 33, the temperature of the roll sheet R is uniform in the width direction X.

When the roll sheet R passes through the platen 33 in the transport direction Y, the roll sheet R receives heat from the heater 44 through the platen 33, thereby increasing the temperature of the roll sheet R.

Here, since the gaps 42 are formed in the boundaries 41, it is difficult to transfer heat to the regions of the roll sheet R facing the gaps 42.

In this embodiment, therefore, the boundaries 41 are curved in the width direction X and the transport direction Y. Positions A to G in the width direction X will be described.

Since the roll sheet R passing through position A in the width direction X is not influenced by the gaps 42 of the boundaries 41, the roll sheet R is easily heated. Accordingly, the temperature at position A is relatively high.

The roll sheet R passing through the position B passes through the boundary 41 at one end of the zigzag shape in the transport direction Y. The roll sheet R is hardly heated in an upper portion of the platen 33 in the transport direction, but can sufficiently receive heat in an intermediate portion and a lower portion of the platen 33 in the transport direction. Accordingly, the temperature of the roll sheet R passing through the position B is slightly lower than that of the roll sheet R passing through the position A.

As the length of the one end of the zigzag shape of the boundary 41 in the transport direction Y becomes shorter, the temperature of the roll sheet R passing through the position B is closer to the temperature of the roll sheet R passing through the position A.

The vicinity of the position B will be described. There are not any boundary 41 formed on the 80-digit side, which is the left side of the position B in FIGS. 3A and 3B in the vicinity of the position B. Accordingly, the temperature of the roll sheet R in the vicinity of the position B on the 80-digit side is similar to the temperature of the position A. On the other hand, on the 1-digit side, which is the right side of the position B in FIGS. 3A and 3B in the vicinity of the position B, the boundaries 41 extend in the width direction X. Accordingly, the temperature of the roll sheet R in the vicinity of the 1-digit side of the position B is similar to the temperature of the position C, which is described below.

That is, the temperature of the roll sheet R passing through the vicinity of the position B is slightly lower than the temperature of the roll sheet R passing through the position A only at the one specific area at the position B. The temperature of the roll sheet R in the vicinity of the position B is equal to or very slightly lower than the temperature of the roll sheet R passing through the position A. In other words, since the temperature of the roll sheet R is slightly lower only at the one specific area at the position B, the temperature of the roll sheet R in the vicinity of the position B is substantially equal to the temperature of the roll sheet R passing through the position A.

The roll sheet R passing through the position C passes through the boundary 41 in the transport direction Y over the gap 42 which is the width of the boundary 41. That is, the roll sheet R is hardly heated in the instant that it posses over. However, since the roll sheet R comes in contact with the medium holding surface 34 of the platen 33 at other regions, the roll sheet R can be sufficiently heated. Accordingly, this temperature is slightly lower than the temperature of the roll sheet R passing through the position A.

The temperature of the roll sheet R passing through the vicinity of the position C is equal to the temperature of the roll sheet R passing through the position C, since this temperature is determined under the same conditions as the temperature of the roll sheet R passing through the position C where the boundaries 41 extend in the width direction X. That is, the temperature of the roll sheet R passing through the vicinity of the position C is uniform in the width direction X.

The roll sheet R passing through the position D passes through the boundary 41 at one end of the zigzag shape in the transport direction Y. The roll sheet R is hardly heated in the intermediate portion of the platen 33 in the transport direction, but can be sufficiently hardly heated in the upper portion and the lower portion of the platen 33 in the transport direction. Accordingly, this temperature is slightly lower than that of the roll sheet R passing through the position A. That is, the temperature of the roll sheet R passing through the position D is similar to the temperature of the roll sheet R passing through the position B.

The temperature of the roll sheet R passing through the vicinity of the position D is similar to the temperature of the roll sheet R in the vicinity of the position B. The description is omitted.

The roll sheet R passing through the position E passes through the boundary 41 in the transport direction Y over the gap 42, which is the width of the boundary 41, similar to position C. That is, the roll sheet R is hardly heated in the instant that it passes over. However, since the roll sheet R comes in contact with the medium holding surface 34 of the platen 33 at other regions, the roll sheet R can be sufficiently heated. Accordingly, this temperature is slightly lower than the temperature of the roll sheet R passing through the position A. That is, this temperature is similar to the temperature of the roll sheet R passing through the position C.

The temperature of the roll sheet R passing through the vicinity of the position E is similar to the temperature of the roll sheet R in the vicinity of the position C. Therefore, the description is omitted.

The roll sheet R passing through the position F passes through the boundary 41 at one end of the zigzag shape in the transport direction Y. The roll sheet R is hardly heated on the downstream side of the platen 33 in the transport direction, but can sufficiently is heated on the upstream side and the intermediate region of the platen 33 in the transport direction. Accordingly, this temperature is slightly lower than that of the roll sheet R passing through the position A. That is, this temperature is similar to the temperature of the roll sheet R passing through the position B.

The temperature of the roll sheet R passing through the vicinity of the position F is similar to the temperature of the roll sheet R in the vicinity of the position B. Therefore, the description is omitted.

Since the roll sheet R passing through the position G is not influenced by the gap 42 of the boundary 41, similar to the position A, the roll sheet R is easily heated. Accordingly, this temperature becomes relatively high. That is, this temperature is similar to the temperature of the roll sheet R passing through the position A.

Only one of the two boundaries 41 has been described. However, the same holds for the other thereof since the boundaries are bisymmetric. Therefore, the description is omitted.

Figures 11A, 11B:
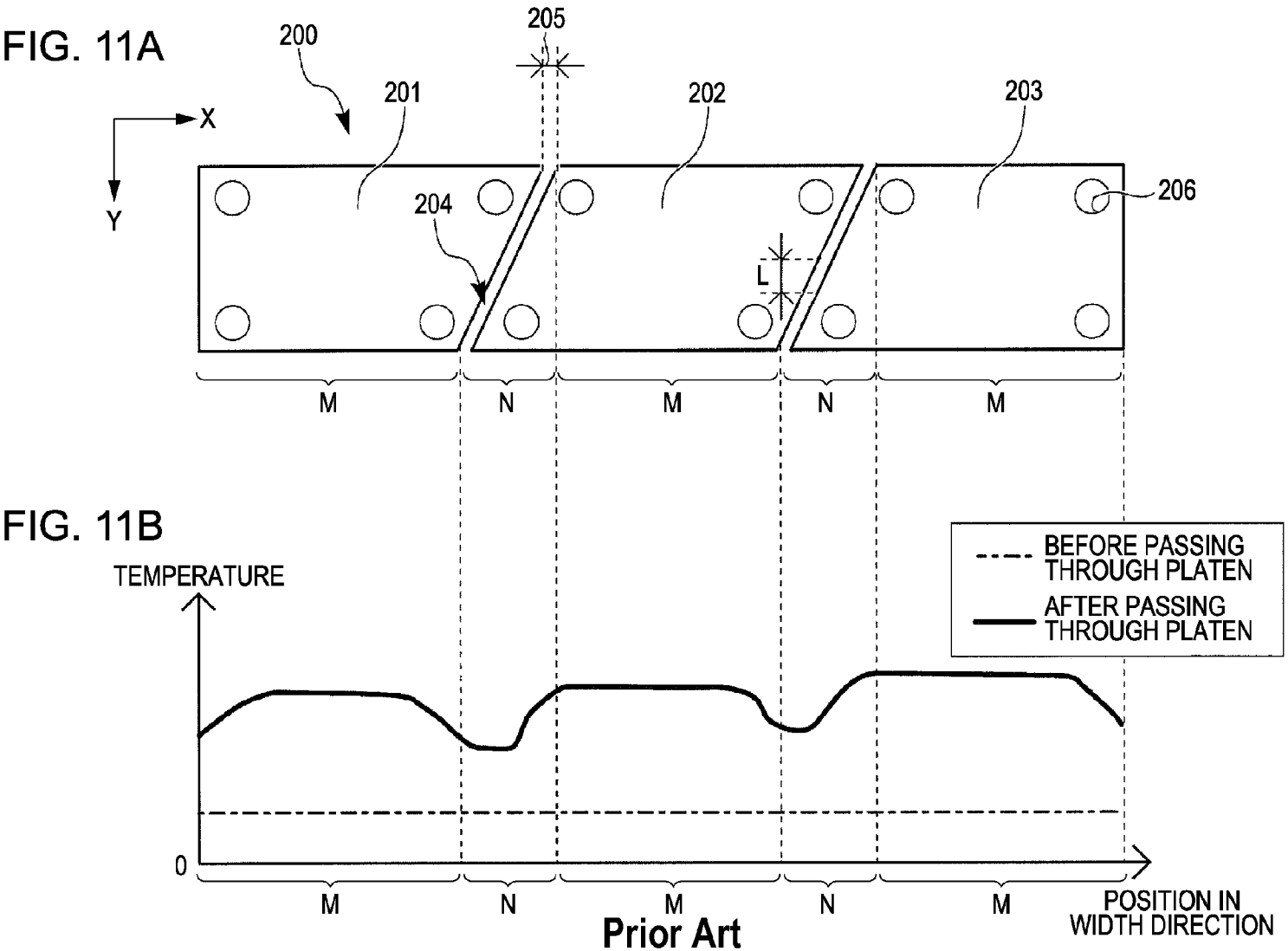
FIG. 11B Prior Art
FIGS. 11A and 11B are a plan view illustrating the platen according to a known technique and a diagram illustrating the temperature of a roll sheet in regions corresponding to the platen.

As described above, the irregularity in the temperature of the roll sheet R, which passes through the platen 33, in the width direction X can be reduced by curving the boundaries 41 in the width direction X and the transport direction Y, compared to the known technique (see FIGS. 11A and 11B). As a consequence, it is possible to reduce an irregularity in the temperature of the roll sheet in the width direction X and an irregularity in the dryness of the roll sheet. Moreover, it is possible to reduce the irregularity in the discoloration of ink caused due to the irregularity in the temperature.

The boundaries 41 are not slightly inclined with respect to the transport direction Y. Accordingly, there will hardly be any occurrences of an end of the printing medium being located on the boundaries, and the end of the printing medium being stuck in the boundaries. Therefore, the entire roll sheet R does not pass obliquely or so-called sheet folding that the end of the roll sheet R is curved does not occur.

In the above-described embodiment, the boundaries are formed in the three-step zigzag shape. However, the number of steps is not particularly limited.

Alternatively, the boundaries may not be necessarily formed in the zigzag shape. The boundaries are not formed in a straight line, but may be curved at one position or many positions.

Alternatively, the boundaries may of course diverge into two or three branches, for example.

In the printer 1 as the printing apparatus according to this embodiment, the medium holding surface 34, which is the holding surface formed by the first member 36, the second member 37, and the third member 38, is divided into the plurality of members, that is, the first member 36, the second member 37, and the third member 38. The printer 1 includes the platen 33 which serves as the medium holding unit for holding the roll sheet R as an example of a printing medium transported by the medium holding surface 34, the heater 44 which is disposed in the platen 33 and is an example of the heat transfer type first heating unit 43 heating the roll sheet R held on the platen 33, and the printing head 31 which performs the printing by ejecting ink onto the roll sheet R. On the medium holding surface 34 of the platen 33, the boundaries 41 formed by the gaps 42 among the first member 36, the second member 37, and the third member 38 are curved in both the transport direction Y and the width direction X of the roll sheet R so as not to be formed in a straight line in the transport direction Y.

Other Embodiment 1

Figure 4:
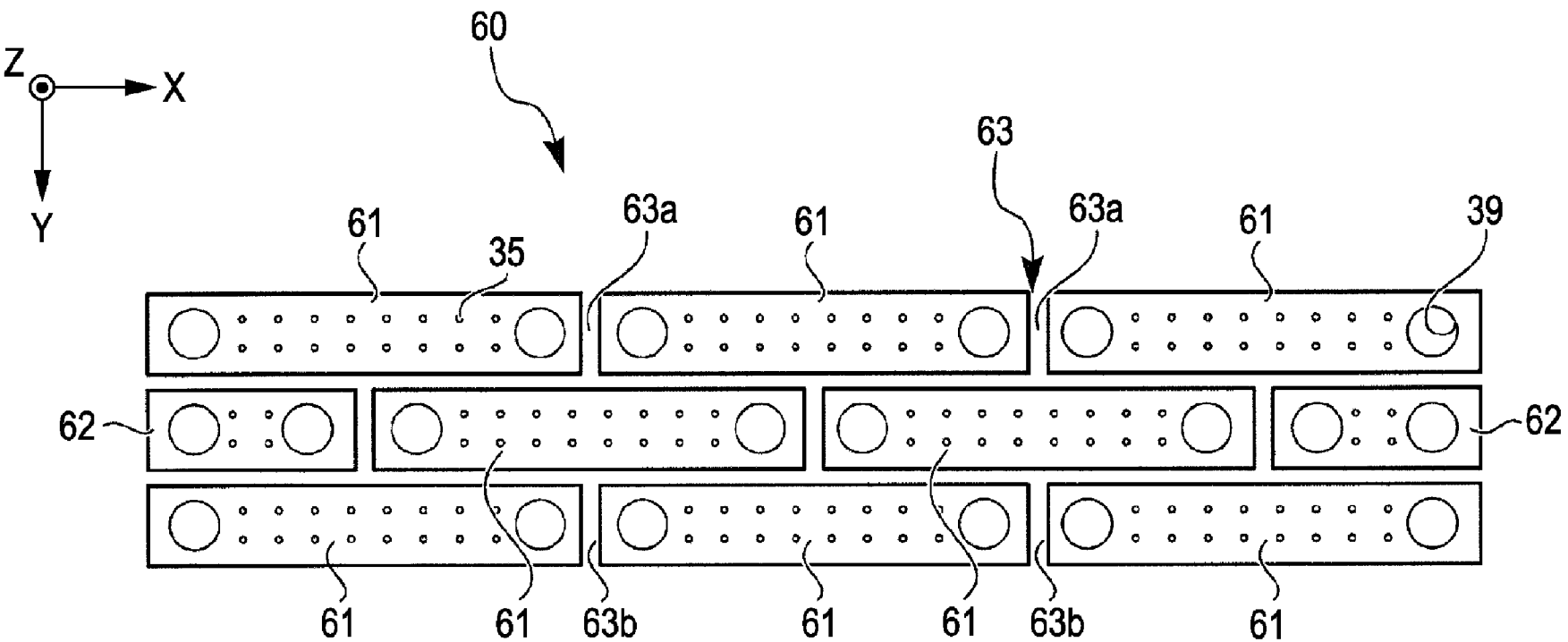
FIG. 4 is a plan view schematically illustrating a platen according to Other Embodiment 1.

FIG. 4 is a plan view illustrating the overall configuration of a platen according to Other Embodiment 1.

As shown in FIG. 4, a medium holding surface 34 of a platen 60 according to Other Embodiment 1 is constituted by a plurality of fourth members 61 and a plurality of fifth members 62.

Members except for the described members are given to the same reference numerals, since the members are the same as those according the above-described embodiment. The description of the same members is omitted.

The medium holding surface 34 of the platen 60 according to Other Embodiment 1 is constituted by three fourth members 61 on the upstream side in the transport direction. On the intermediate region in the transport direction, the medium holding surface 34 of the platen 60 is constituted by two fourth members 61 disposed in the middle in the width direction X and two fifth members 62 disposed on both ends in the width direction X. On the downstream side in the transport direction, the medium holding surface 34 of the platen 60 is constituted by three fourth members 61, like the upstream side. That is, the platen 60, which is a variant of the platen according to the above-described embodiment, forms the medium holding surface 34 by using a different number of members and members with different shapes.

Boundaries 63, which are formed between the adjacent members, are curved in the width direction X and the transport direction Y so as not to be formed in a straight line in the transport direction Y, as in the above-described embodiment. Accordingly, the same advantages as in the above-described embodiment can be obtained.

Specifically, the irregularity in the temperature of the roll sheet R, which passes through the platen 60, in the width direction X can be reduced, compared to the known technique.

It is desirable that the positions of boundaries 63*a* extending in the transport direction Y on the upstream side of the platen 60 in the transport direction Y do not overlap in the width direction X with the positions of boundaries 63*b* extending in the transport direction Y on the downstream side of the platen 60 in the transport direction Y. This is because it will reduce the degree to which the temperature of the roll sheet R is lowered, compared to the temperature of other regions. That is, this is because the regions with lower temperatures can be dispersed.

Other Embodiment 2

Figure 5A:
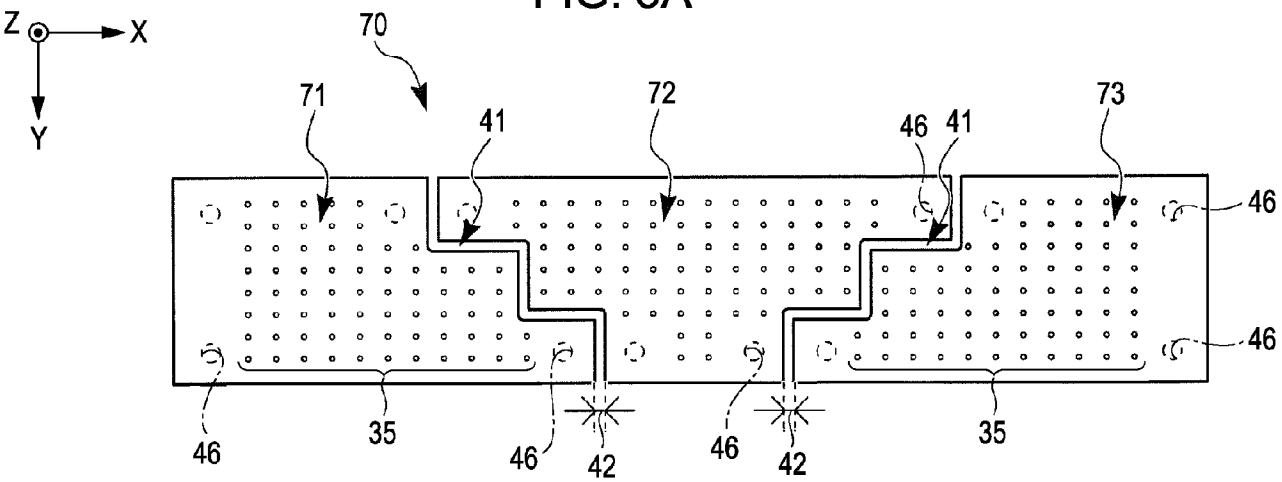
FIGS. 5A and 5B are diagrams illustrating the overall configuration of a platen according to Other Embodiment 2.
Figure 5B:
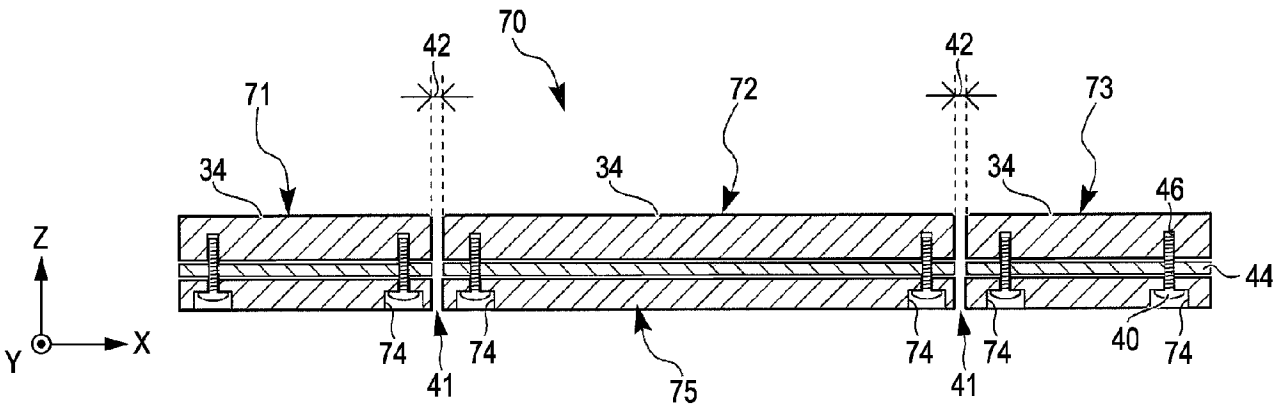

FIGS. 5A and 5B are diagram illustrating the overall configuration of a platen according to Other Embodiment 2. FIG. 5A is a plan view illustrating the platen and FIG. 5B is front sectional view illustrating the platen.

As shown in FIGS. 5A and 5B, a plurality of screw holes 74 is formed in the plate-shaped member 75 and is used to mount the heater 44 and a plate-shaped member 75 to a platen 70 according to Other Embodiment 2. That is, the screw holes 39 (see FIG. 2A) are not formed on the medium holding surface 34.

The same reference numerals are given to the same members of the above-described embodiment except for members described below. The description of the same member is omitted.

A plurality of screws 40 is inserted and screw-fixed to the screw holes 74 from the plate-shaped member 75 side toward the platen 70 side in the Z axis direction. In this case, the female screw-shape portions 46 are of course disposed in the platen 70.

The medium holding surface 34 of the platen 70 can be formed as a smooth surface without an uneven portion in regions except for the gaps 42 of the boundaries 41.

That is, the medium holding surface can be formed without the uneven portion formed due to the screw holds 39 (see FIG. 2A). Accordingly, the medium holding surface 34 can come in uniform contact with the roll sheet R in the regions other than the gaps 42 of the boundaries 41.

As a consequence, the heat of the heater 44 can uniformly be transferred to the roll sheet R through the platen 70.

When the screw holes 39 (see FIG. 2A) are formed in the medium holding surface 34 of the platen 70, the screw holes 39 can be covered with cap members (not shown) to eliminate the uneven portions after the screws have been screw-fixed. In this case, unnecessary spaces may be formed between the cap members and the screws 40, and thus an irregularity in the heat transfer may arise.

The platen 70 according to Other Embodiment 2 is configured such that the heater 44 is mounted in the platen 70 from a side opposite to the medium holding surface 34. Accordingly, the platen 70 according to Other Embodiment 2 can transfer the heat to the roll sheet R in a more uniform manner, compared to the configuration in which the uneven portion is eliminated using the cap members. That is, it is possible to reduce the irregularity in the temperature of the roll sheet R.

Of course, the screw holes may be formed in the medium holding surface 34 in the region where the roll sheet or the single sheet is not placed on the medium holding surface 34 of the platen 70.

In Other Embodiment 2, the heater 44, which is the first heating unit 43, is screw-fixed to the platen 70 from the opposite side of the medium holding surface 34.

In Other Embodiment 2, a sixth member 71, a seventh member 72, and an eighth member 73 are flush with each other so as to form a smooth surface except for the gaps 42 of the boundaries 41 on the medium holding surface 34 of the platen 70.

Other Embodiment 3

Figure 6:
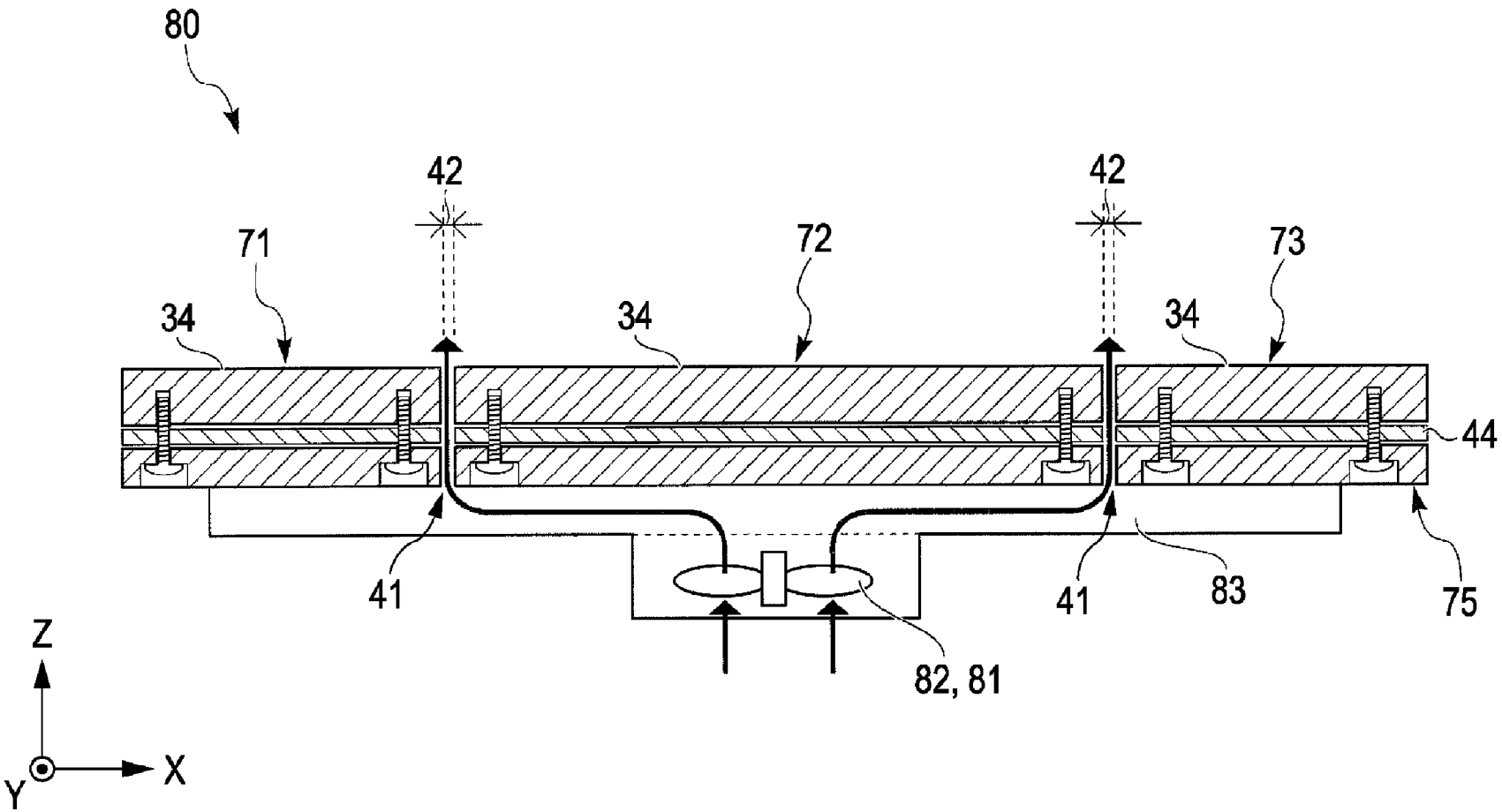
FIG. 6 is a front sectional view illustrating the overall configuration of a platen according to Other Embodiment 3.

FIG. 6 is a front sectional view illustrating the overall configuration of a platen according to Other Embodiment 3.

As shown in FIG. 6, a platen 80 according to Other Embodiment 3 includes a convection type second heating unit 81 heating the roll sheet R on the platen 80.

Here, "the convection type" refers to a method of transferring heat by a fluid such as a gas or a liquid.

Specifically, a warm air fan 82 serves as the second heating unit 81. The warm air fan 82 includes a heat generating member (not shown) such as a nichrome wire and a wind generating member such as a fan.

The same reference numerals are given to the same members of the above-described embodiment except for members which are described below. The description of the same members is omitted.

The warm air fan 82 is disposed so as to be on the side opposite to the platen 80 of the plate-shaped member 75. The warm air fan 82 is configured so as to blow warm air from the gaps 42 of the boundaries 41 of the medium holding surface 34 of the platen 80 to the roll sheet R on the platen 80 through a passage section 83. Accordingly, the warm air fan 82 can blow warm air to the roll sheet R by an amount of heat lost through the gaps 42 of the boundaries 41 when the heat is transferred from the heater from the heater 44 to the roll sheet R through the platen 80.

As a consequence, it is possible to further reduce the slight irregularity in the temperature of the roll sheet R caused by the gaps 42 of the boundaries 41.

The blowing force of the warm air fan 82 is sufficiently smaller than the suction force of the suction fan 49 and hardly affects the suction force of the suction fan 49. This is because when the blowing force is larger than the suction force, it is difficult to transfer heat of the heater 44 to the roll sheet R in a heat transfer manner. Moreover, this is because the position of the roll sheet R may become unstable.

In Other Embodiment 3, the platen 80 is provided with the warm air fan 82 as an example of the convection type second heating unit 81 blowing warm air to the roll sheet R on the medium holding surface 34 through the gaps 42 of the boundaries 41 between the plurality of members, that is, the sixth member 71, the seventh member 72, and the eighth member 73.

Other Embodiment 4

Figure 7:
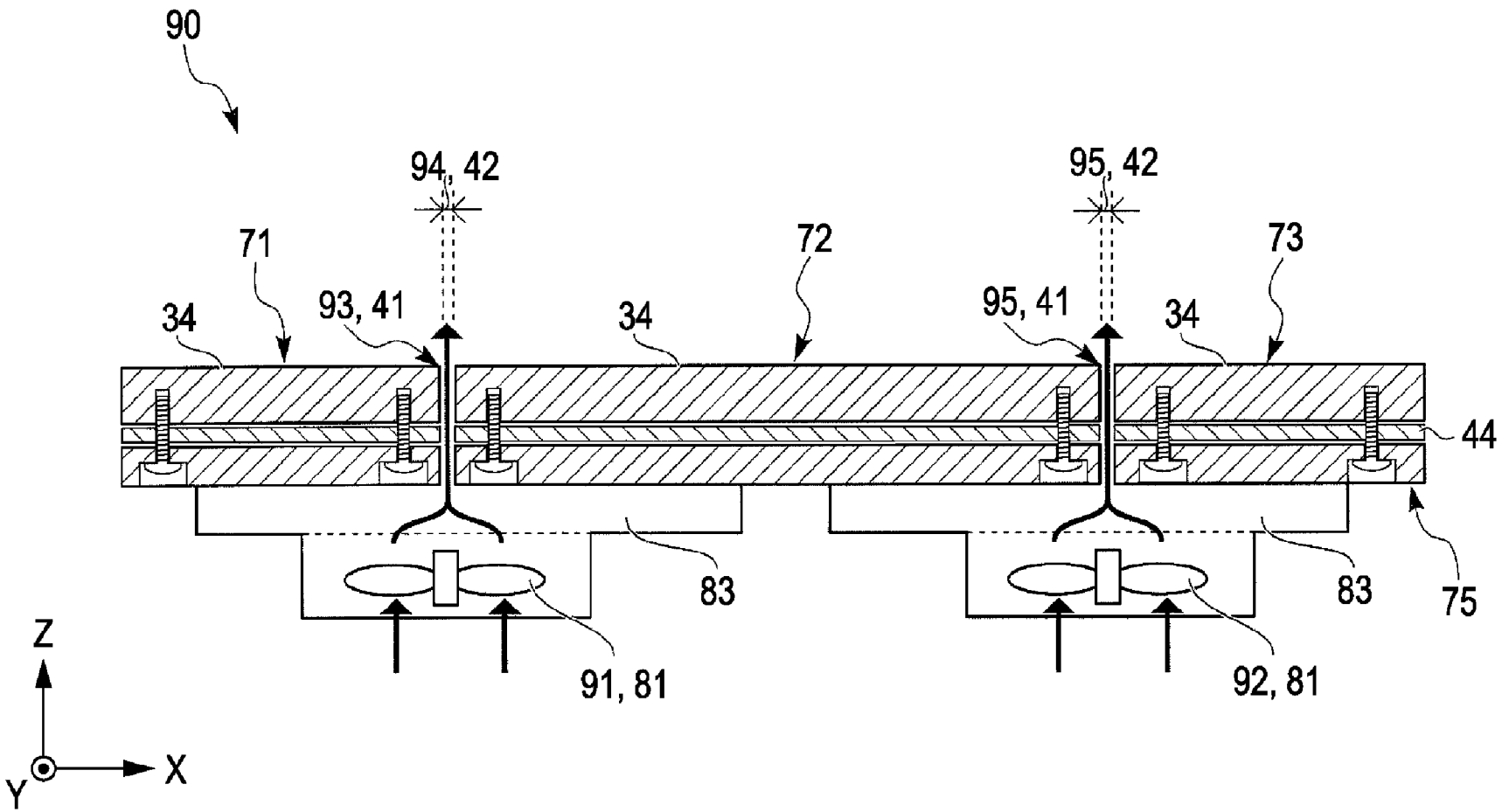
FIG. 7 is a front sectional view illustrating the overall configuration of a platen according to Other Embodiment 4.

FIG. 7 is a front sectional view illustrating the overall configuration of a platen according to Other Embodiment 4.

As shown in FIG. 7, a platen 90 according to Other Embodiment 4 includes the second heating unit 81, as in Other Embodiment 3 described above.

The same reference numerals are given to the same members of the above-described embodiment except for members which are described below. The description of the same members is omitted.

The platen 90 according to Other Embodiment 4 includes a plurality of warm air fans serving as the second heating unit 81. Specifically, the platen 90 includes a first warm air fan 91 and a second warm air fan 92. The first warm air fan 91 can blow warm air to the roll sheet R through a first gap 94 of a first boundary 93 which is one of two boundaries 41.

On the other hand, the second warm air fan 92 can blow warm air to the roll sheet R through a second gap 96 of a second boundary 95 which is the other one out of two boundaries 41.

A controller (not shown) turns on one or both of the warm air fans in accordance with the width size of the roll sheet R. That is, the gap 42 of the boundaries 41 facing the roll sheet R is selected in accordance with the size of the roll sheet R so that the warm air fan blows the warm air to the roll sheet R only through the gap 42 facing the roll sheet R. Accordingly, since the warm air is not blown onto the region where the warm air is not necessary, the warm air does not waste.

Alternatively, a plurality of warm air passages connected to the gaps 42 of the boundaries 41 may be provided for only one of the warm air fans. In this case, the controller may open or close the passages by providing an opening valve in each of the plurality of passages.

Other Embodiment 5

Figure 8:
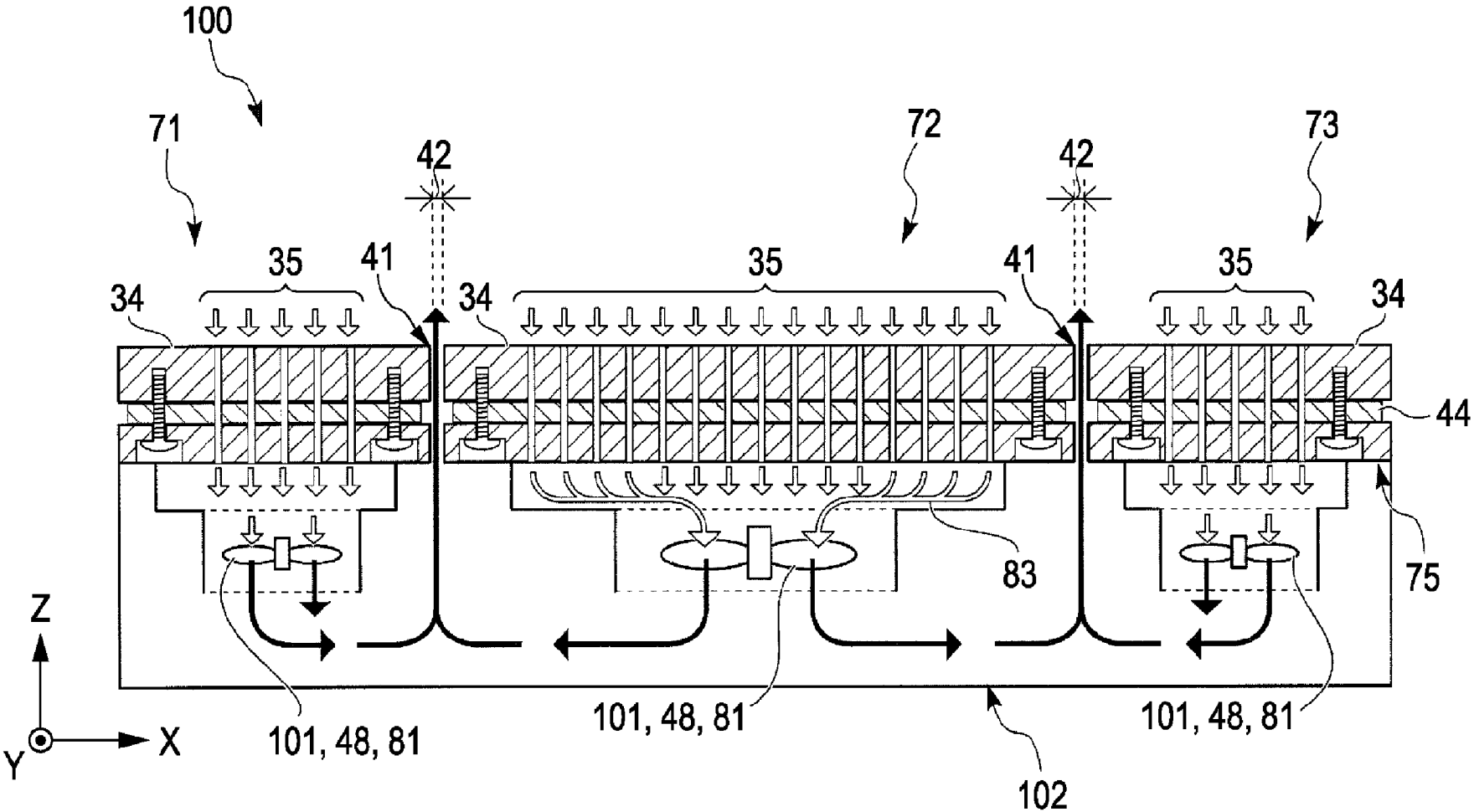
FIG. 8 is a front sectional view illustrating the overall configuration of a platen according to Other Embodiment 5.
Figure 9:
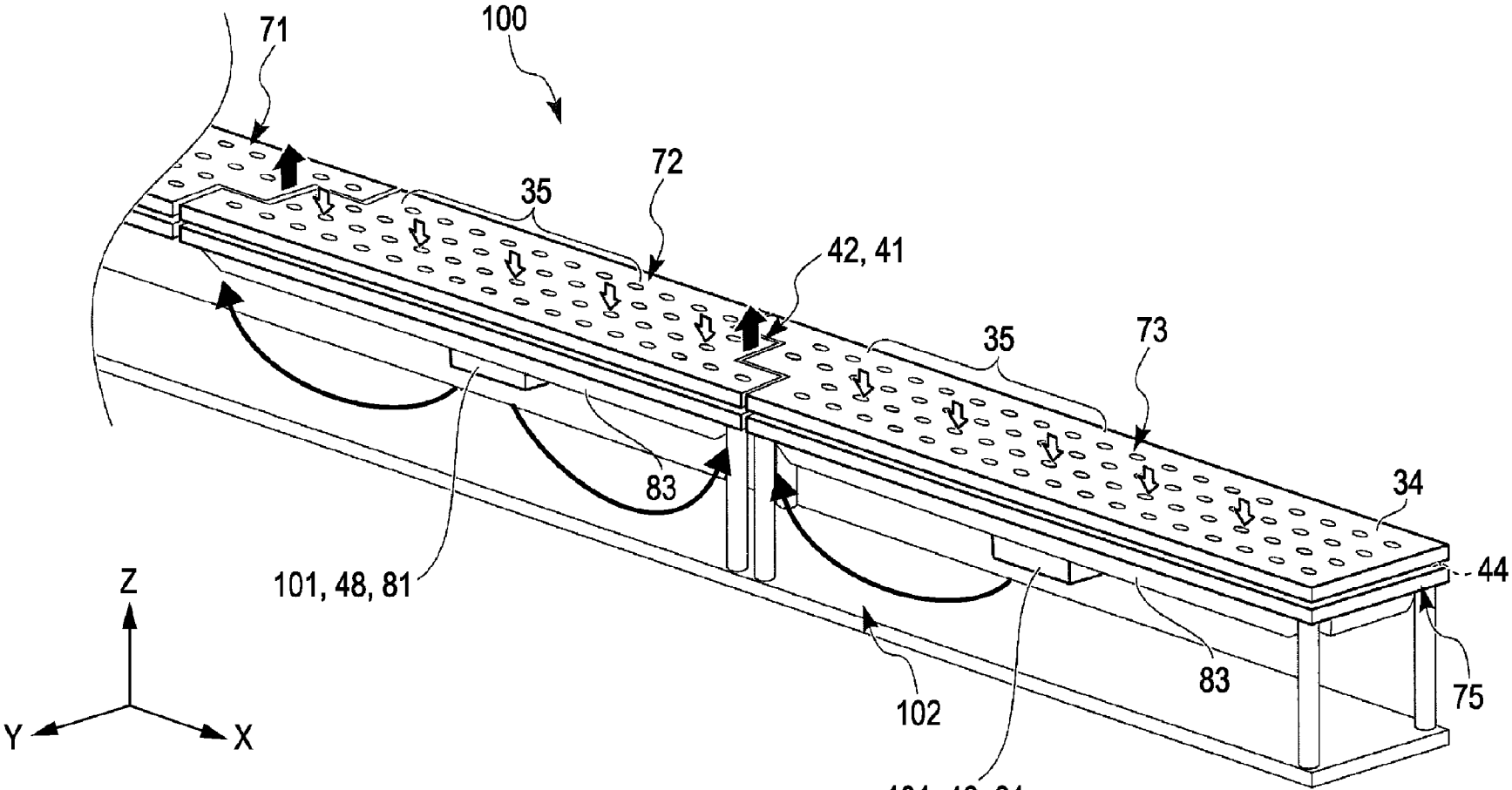
FIG. 9 is a perspective view illustrating the platen according to Other Embodiment 5.
Figure 10:
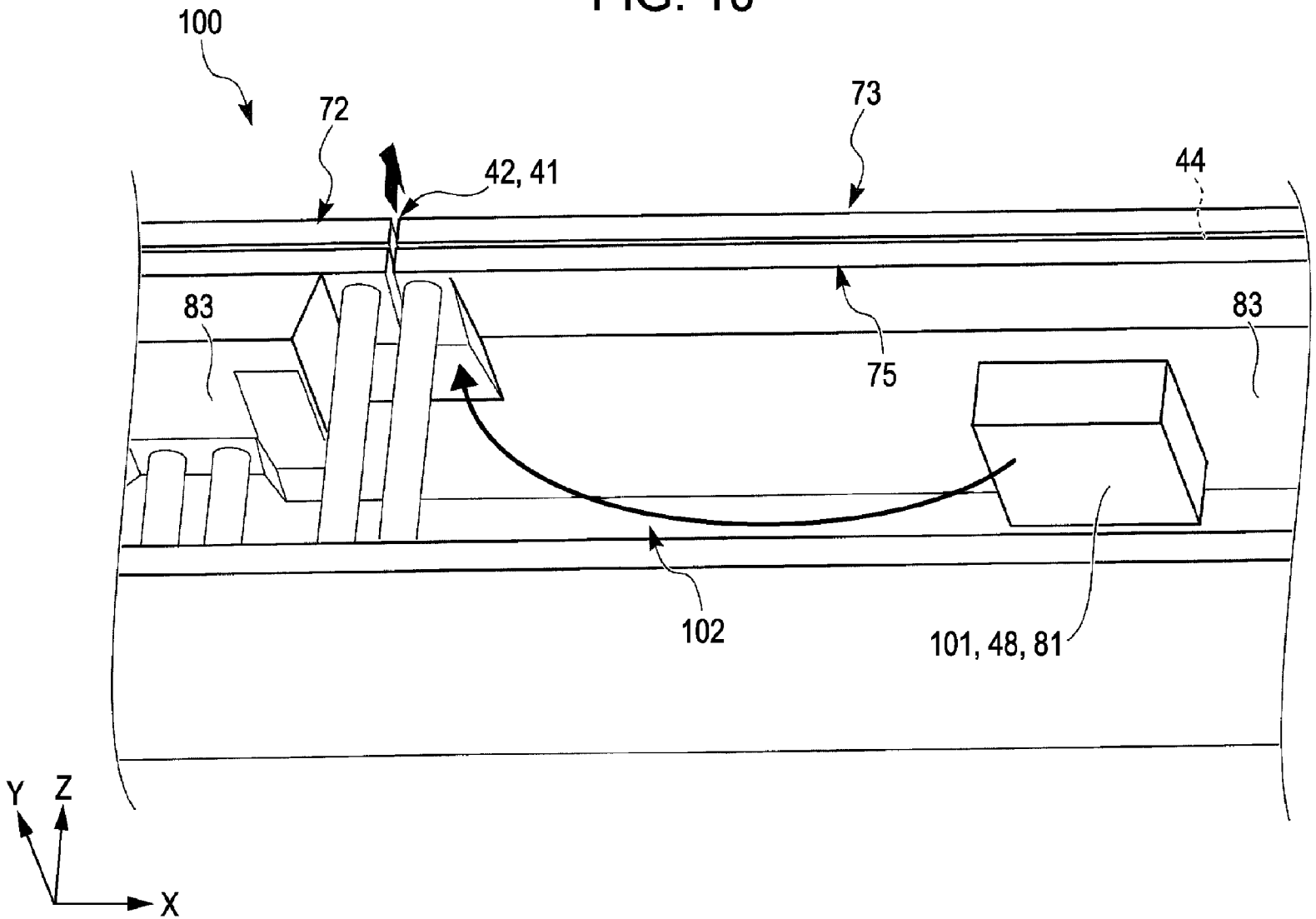
FIG. 10 is a perspective view illustrating the platen viewed from the lower side according to Other Embodiment 5.

FIG. 8 is a front sectional view illustrating the overall configuration of a platen according to Other Embodiment 5. FIG. 9 is a perspective view illustrating the platen according to Other Embodiment 5. FIG. 10 is a perspective view illustrating the platen viewed from the lower side according to Other Embodiment 5.

In FIGS. 9 and 10, for easy understanding, the side wall of a casing is not illustrated.

As shown in FIGS. 8 to 10, a platen 100 according to Other Embodiment 5 includes a warm air fan 101.

The same reference numerals are given to the same members of the above-described embodiment except for members described below. The description of the same member is omitted.

The warm air fan 101 according to Other Embodiment 5 serves as both the second heating unit 81 according to Other Embodiment 3 described above and the suction unit 48 (see FIGS. 1A and 1B) according to the above-described embodiment. Specifically, the warm air fan 101 is disposed in the same manner as the sucking fan 49 of the sucking unit 48 according to the above-described embodiment. Accordingly, the air on the side of the medium holding surface 34 can be sucked from the plurality of suction holes 35 formed in the platen 100.

Since the medium holding surface 34 is heated by the heater 44 serving as the first heating unit 43, the air near the medium holding surface 34 is also heated. Accordingly, the sucked air is relatively warm. The warm air fan 101 discharges the warm air toward a casing 102 disposed below the platen 100. When the warm air is continuously discharged toward the casing 102, the air pressure in the casing 102 becomes high. Therefore, the warm air is blown onto the medium holding surface 34 from the gaps 42 of the boundaries 41.

With such a configuration, it is possible to transfer heat to the roll sheet R through the gaps 42 of the boundaries 41. That is, the regions of the roll sheet R facing the gaps 42 of the boundaries 41 are heated using the sucked warm air. Like the second heating unit 81 according to Other Embodiment 3 described above, it is possible to further reduce the slight irregularity in the temperature of the roll sheet R by using the gaps 42 of the boundaries 41. Moreover, it is possible to reduce heat energy being wasted. That is, the heat can be efficiently transferred from the heater 44 of "the heat transfer type" and "the convection type" to the roll sheet R.

Of course, the blowing force from the gaps 42 of the boundaries 41 by the warm air fan 101 serving as the second heating unit 81 is smaller than the suction force from the suction holes 35 by the warm air fan 101 serving as the suction unit 48.

This is because it is difficult to transfer the heat of the heater 44 to the roll sheet R in the heat transfer manner, when the blowing force is larger than the suction force. Moreover, this is because the position of the roll sheet R becomes unstable.

In order to make the blowing force smaller than the suction force, holes may be formed in the casing 102 to adjust the blowing force that it will be smaller.

In Other Embodiment 5, the platen 100 includes the plurality of suction holes 35 formed in the medium holding surface 34 and the warm air fan 101 serving as the suction unit 48 sucking air from the side of the medium holding surface 34 of the platen 100 toward the opposite side of the medium holding surface 34 through the suction holes 35. The convection type second heating unit 81 blows warm air to the roll sheet R through the gaps 42 of the boundaries 41 by using air discharged when the warm air fan 101, which serves as the suction unit 48, sucks the air heated by the heat transfer type first heating unit 43.

The invention is not limited to the above-described embodiments, but may be modified in various forms within the scope of claims of the invention. Of course, the modified examples are also included in the scope of the invention.

What is claimed is:

1. A printing apparatus comprising:

a medium holding unit which is divided into a plurality of members to form a holding surface and holds a printing medium being transported on the holding surface;

a heat transfer type first heating unit which is disposed in the medium holding unit and heats the printing medium held by the medium holding unit; and a printing head which performs printing by ejecting ink onto the printing medium, wherein boundaries formed by gaps between the plurality of members on the holding surface of the medium holding unit are curved in a zigzag shape in a transport direction and a width direction of the printing medium so as not to be in a straight line shape in the transport direction.

2. The printing apparatus according to claim 1, further comprising a convection type second heating unit which blows warm air to the printing medium held on the holding surface through the gaps of the boundaries between the plurality of members of the medium holding unit.

3. The printing apparatus according to claim 2, further comprising:

a plurality of suction holes which are formed in the holding surface of the medium holding unit; and a suction unit which sucks air from the side of the holding surface of the medium holding unit toward an opposite side of the holding surface through the suction holes, wherein the convection type second heating unit blows warm air to the printing medium through the gaps of the boundaries by using air discharged when the air heated by the heat transfer type first heating unit is sucked by the suction unit.

4. The printing apparatus according to claim 1, wherein the first heating unit is screw-fixed to the printing holding unit from an opposite side of the holding surface of the medium holding unit.

5. The printing apparatus according to claim 1, wherein regions except for the gaps of the boundaries on the holding surface of the medium holding unit are flush with each other so as to form a smooth surface.

* * * * *